US005462412A

United States Patent [19]

Scofield et al.

[11] Patent Number: 5,462,412

[45] Date of Patent: Oct. 31, 1995

[54] CEILING FAN

[75] Inventors: Robert L. Scofield, Cordova; Richard A. Pearce, Memphis, both of Tenn.

[73] Assignee: Hunter Fan Company, Memphis, Tenn.

[21] Appl. No.: 183,572

[22] Filed: Jan. 18, 1994

Related U.S. Application Data

[63] Continuation of Ser. No. 49,958, Apr. 19, 1993, abandoned, which is a continuation of Ser. No. 827,285, Jan. 29, 1992, abandoned.

[51] Int. Cl.[6] ..... F04D 29/34; F04D 29/64

[52] U.S. Cl. ..... 416/210 R; 416/5; 416/244 R; 416/246; 248/343

[58] Field of Search ..... 416/5, 170 R, 416/170 C, 244 R, 246, 204 R, 210 R; 248/343

[56] References Cited

U.S. PATENT DOCUMENTS

| | | | |
|---|---|---|---|
| D. 326,905 | 6/1992 | Scofield | D23/411 |
| D. 328,951 | 8/1992 | Scofield et al. | D23/411 |
| 886,292 | 9/1907 | Meston . | |
| 1,241,245 | 9/1917 | Parker | 416/5 |
| 2,079,942 | 5/1937 | Levelle . | |
| 4,402,649 | 9/1983 | Laurel | 416/5 |
| 4,508,958 | 4/1985 | Kan et al. | 416/5 |
| 4,518,314 | 5/1985 | Schultz . | |
| 4,592,702 | 6/1986 | Bogage . | |
| 4,634,345 | 1/1987 | Stanek et al. . | |
| 4,714,230 | 12/1987 | Huang . | |
| 4,721,480 | 1/1988 | Yung | 416/5 |
| 4,729,725 | 3/1988 | Markwardt . | |
| 4,863,346 | 9/1989 | Lin | 416/5 |
| 4,878,806 | 11/1989 | Markwardt | 416/5 |
| 4,884,947 | 12/1989 | Rezek . | |
| 4,936,751 | 6/1990 | Marshall . | |
| 5,154,579 | 10/1992 | Rezek | 416/5 |

FOREIGN PATENT DOCUMENTS

| | | | |
|---|---|---|---|
| 110798 | 7/1982 | Japan | 416/5 |
| 101292 | 6/1983 | Japan | 416/5 |
| 478417 | 1/1938 | United Kingdom . | |
| 783431 | 9/1957 | United Kingdom . | |
| 1508076 | 4/1978 | United Kingdom . | |
| 2076468 | 12/1981 | United Kingdom . | |
| 2214571 | 6/1989 | United Kingdom . | |

OTHER PUBLICATIONS

Brochure, "Beverly Hills Fan Co.", Beverly Hills Fan Company, Woodland Hills, California, Dec. 1991.

*Primary Examiner*—Edward K. Look
*Assistant Examiner*—James A. Larson
*Attorney, Agent, or Firm*—Baker, Donelson, Bearman and Caldwell

[57] ABSTRACT

A ceiling fan is disclosed comprising a motor having a stator with a top portion and a bottom portion and a rotor having a bottom portion, a down rod secured to the top portion of the stator for suspending the motor from the ceiling, a motor housing enclosing at least a portion of the motor, at least one switch for selectively controlling the operation of the motor, a plurality of blades removably securable by suitable fastening devices to the bottom portion of the rotor, and a switch housing for containing at least one switch securable to the bottom portion of the stator, an upper edge portion of the switch housing being operable to conceal from view at least a portion of the fastening devices used to secure the blades to the motor. The ceiling fan of the preferred embodiment also includes blade irons for attaching the proximate ends of the blades to the motor, the blade irons including arcuate flanges which, collectively, form a substantially continuous ring around the upper portion of the switch housing, thereby further concealing from view the fastening devices used to secure the blade irons to the motor.

7 Claims, 6 Drawing Sheets

CEILING FAN

This is a continuation of application Ser. No. 08/048,958 filed on Apr. 19, 1993, abandoned which was a continuation of Ser. No. 07/827,285 filed on Jan. 29, 1992, now abandoned.

BACKGROUND OF THE INVENTION

1. Field of the Invention

The present invention relates to ceiling fans and, more particularly, to ceiling fans having an improved switch housing/blade iron relationship.

2. Description of the Prior Art

Electric ceiling fans are commonly utilized to assist heating and air conditioning systems by providing an additional degree of air circulation within the confines of a room. Most modern ceiling fans consist of an electric motor suspendable by a shaft from a ceiling, with a plurality of blades mounted to either the top or bottom surface of the motor. Conventional ceiling fans typically incorporate one or more electrical switches for controlling the speed and rotational direction of the motor, said switches being encased within a switch housing disposed beneath the motor.

In the case of ceiling fans having blades mounted to the bottom surface of the motor, blade irons to which the blades are secured are typically attached to the motor by means of a plurality of screws. While blade irons can be quite ornate and decorative, the multiplicity of screws utilized to secure blade irons to the blades and the motor are unsightly.

U.S. Pat. No. 4,884,947 issued Dec. 5, 1989, entitled "CEILING FAN ASSEMBLY" demonstrates one effort to create an aesthetically pleasing ceiling fan, wherein the blade irons and associated screws are hidden from view. The fan disclosed in the '947 patent, however, represents a radical ultra-modern configuration which is suitable for use in a very limited number of environments. Additionally, this fan is composed of an unusually large number of components, thereby increasing the cost and complexity of the assembly for the user.

Conventional ceiling fans are typically adapted for mounting the blades and motor in a plurality of spaced-apart relationships relative to a ceiling, in order to accommodate vaulted and/or unusually high ceilings. Some fans are configured exclusively for mounting close to the ceiling, while others are configured exclusively for being suspended at a distance from the ceiling by a rod or tube. Most, however, are suited for either mounting position, in which case the canopy typically includes unsightly mounting holes for attaching the motor directly to the canopy. Such holes are not visible when the fan is mounted close to the ceiling, but are visible when the fan is suspended at a distance below the ceiling.

There is a need in the art for a ceiling fan having a simplified, yet aesthetically pleasing structure, with an appearance suitable for use in most contemporary applications. There is a further need for a ceiling fan adaptable for mounting either close to, or suspended at a distance from, a ceiling, having an aesthetically improved canopy with no additional mounting holes exposed in either position.

BRIEF SUMMARY OF THE INVENTION

This invention provides a unique ceiling fan assembly having a switch housing specially configured to shield the proximate ends of the blade irons from below. The blade irons are also uniquely adapted to form a substantially continuous ring around the upper portion of the switch housing, thereby shielding the distal ends of the blade irons and corresponding screws from view from the side. The distal ends of the blade irons are adapted to receive screws from above, such screws being employed to secure the blades to the blade irons.

This invention also employs a unique apparatus for converting the fan from a mounting position suspended at a distance from the ceiling to a position close to the ceiling. This apparatus comprises a canopy securable flush against the ceiling, a ring member disposable within the canopy when the fan is to be mounted close to the ceiling, and a special adapter secured to the fan motor adapted to engage either a down rod, when the fan is to be suspended at a distance from the ceiling, or the ring.

DETAILED DESCRIPTION OF THE PREFERRED EMBODIMENT

Figure 1:
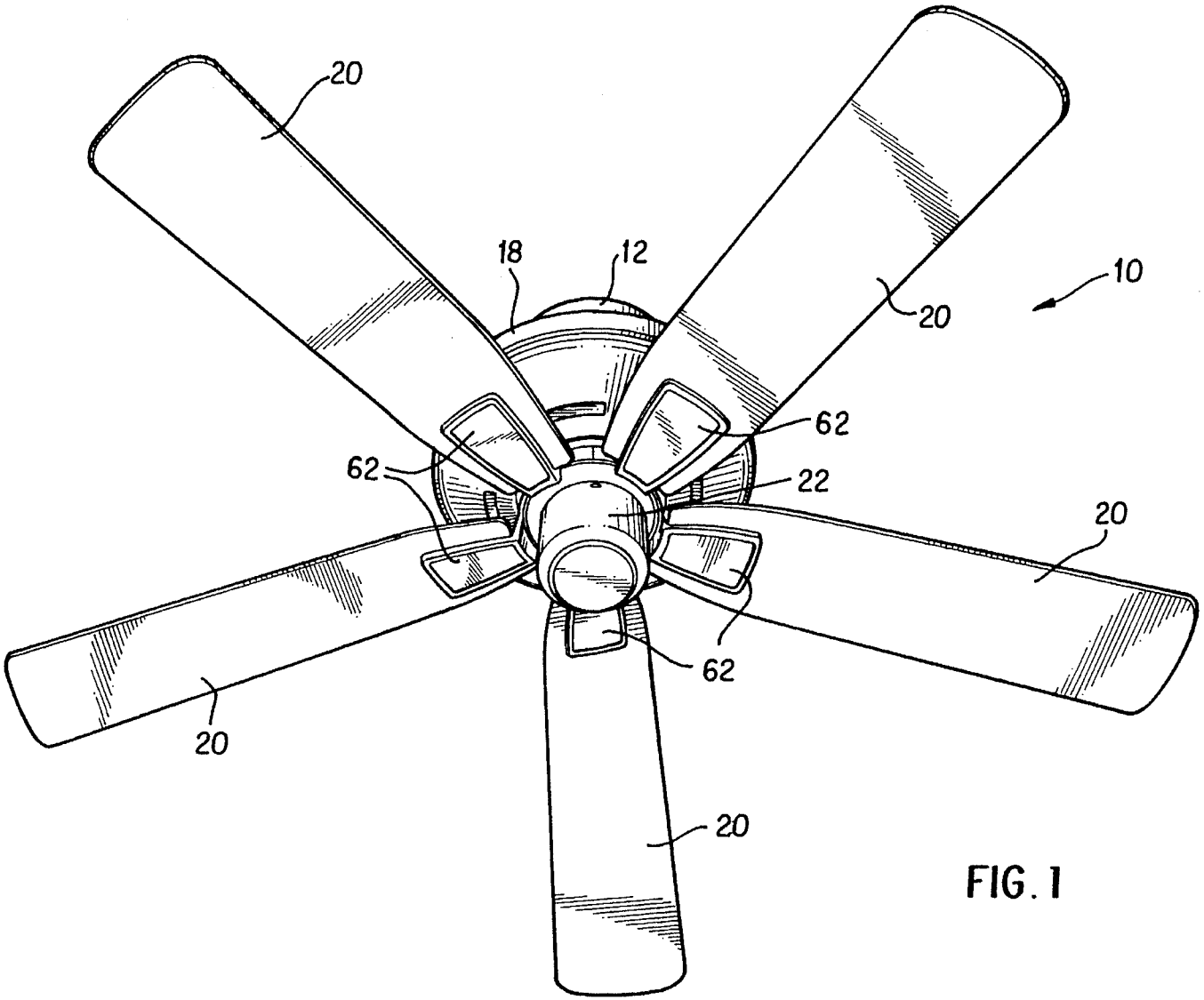
FIG. 1 is a perspective view of a ceiling fan incorporating principles of the present invention.
Figure 2:
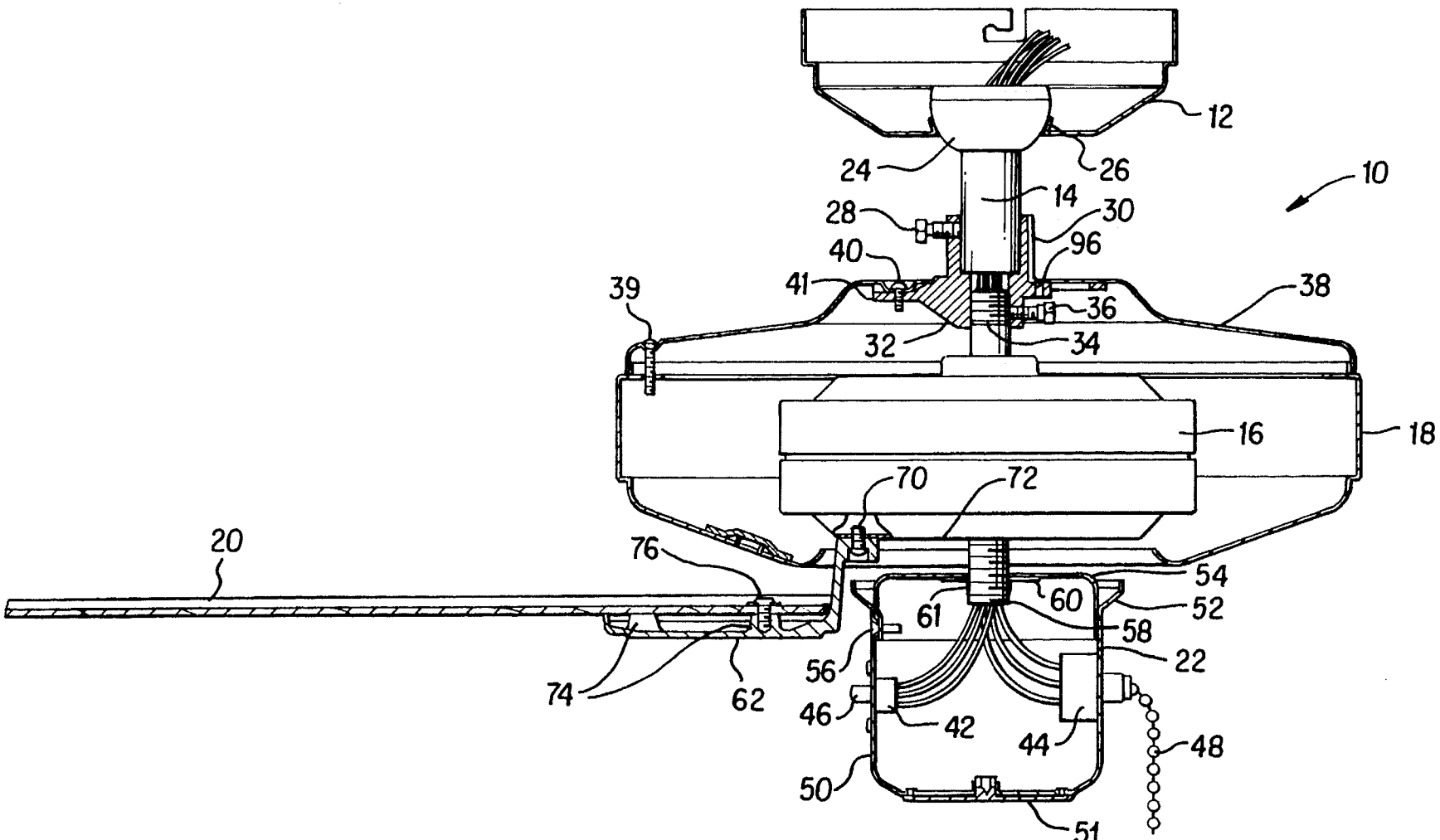
FIG. 2 is a side sectional view through the motor housing, switch housing and a representative blade and blade iron of the preferred embodiment of the present invention, showing the ceiling fan suspended at a distance from the ceiling.

Referring initially to FIGS. 1 and 2, the preferred embodiment of the present invention is a ceiling fan 10, comprising a canopy 12 securable to a ceiling (not shown), down rod 14 pivotally retained in canopy 12, electric motor 16 encased by motor housing 18, a plurality of blades 20, and switch housing 22. Ball member 24 is secured to the upper end of down rod 14 and is configured to seat within specially adapted socket 26 which is integrally formed in canopy 12. The lower end of down rod 14 is retained by set screw 28 within adapter 30, the lower portion 32 of which is threadingly engaged to upper stationary threaded member 34 of motor 16 and further secured thereto by set screw 36. Top portion 38 of housing 18 is secured to adaptor 30 by screws 40 engaging threaded holes 41 in adapter 30. A plurality of equally spaced apart screw 39 secure top portion 38 to the lower portion of housing 18.

Ceiling fan 10 preferably includes at least two control switches 42 and 44 for controlling the speed and direction of rotation for motor 16. A shown in FIG. 2, switches 42 and 44 are secured within switch housing 22, with switch 42 controlling the direction of rotation for motor 16 by selective operation of button 46, and switch 44 controlling the speed of rotation by selective operation of chain 48. As will be fully understood by those skilled in the art, however, the number and type of switches employed can be varied as desired without departing from the scope of this invention. Switches 42 and 44 are given by way of example only, and should not constitute any limitation on the scope of this invention.

In the preferred embodiment shown, switch housing 22 has a generally cylindrical side wall 50, with a radially outwardly flared upper lip portion 52. Cylindrical side wall 50 is secured to cap member 54 by at least one screw 56. Nut 60, comprising a sheet metal stamping having an internal threaded portion 61, is preferably welded to cap member 54 in a manner allowing for threading engagement of portion 61 with lower stationary threaded member 58, thereby securing switch housing 22 in place. The lower edge of cylindrical side wall 50 forms a generally circular opening having cover 51 removably secured therein. Cover 51 is preferably formed from a suitable plastic or resilient metal material and is snapped into place, removal thereof providing access to switches 42 and 44 and their associated wiring. Those skilled in the art will appreciate the fact that cover 51 is uniquely securable without the need for any additional fastening means, such as screws, as required with conventional switch housings.

Those skilled in the art will readily recognize that motor 16 of ceiling fan 10 is largely conventional. While the electromagnetic characteristics of motor 16 are irrelevant to the present invention, it may be helpful to note that upper stationary threaded member 34 and lower stationary threaded member 58 are typical components of the stator portion of a conventional electric motor, with the remainder of motor 16 as illustrated comprising a generally conventional rotor.

Figure 4:
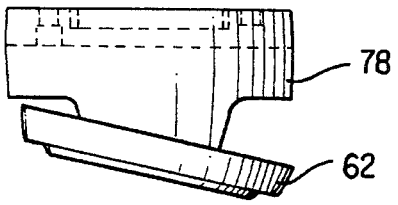
FIG. 4 is an end elevational view of a blade iron of the preferred embodiment of the invention.
Figure 5:
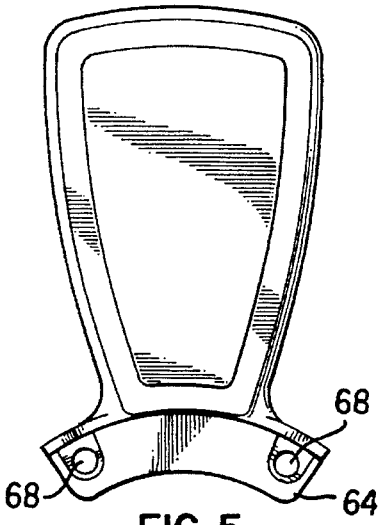
FIG. 5 is a bottom plan view of the blade iron shown in FIG. 4.
Figure 6:
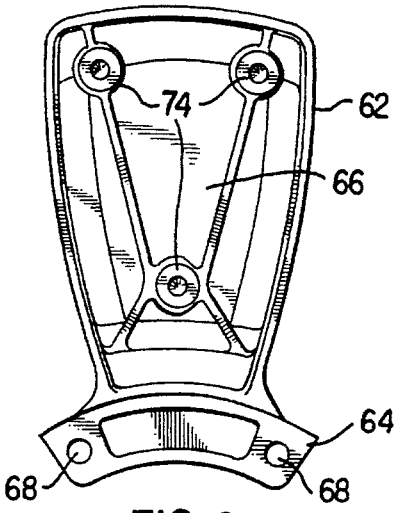
FIG. 6 is a top plan view of the blade iron shown in FIGURES 4 and 5.

In the preferred embodiment shown, ceiling fan 10 has five blades 20 and a equal number of blade irons 62. As best shown in FIGS. 4–6, each blade iron 62 has a proximate end 64 and a distal end 66. Proximate end 64 has a pair of holes 68 formed therethrough for receiving screws 70 which engage suitable threaded holes formed within lower surface 72 of motor 16. Distal end 66 of blade irons 62 has three threaded bosses 74 integrally formed therein, which threadingly engage screws 76 to secure blades 20 to the top surface of blade irons 62.

Blade irons 62 include a downwardly extending flange 78, as best seen in FIG. 4. Flanges 78 provided by the plurality of blade irons 62 cooperate to collectively form a substantially continuous ring 80 which generally encircles upper lip portion 52 of switch housing 22. In the five-bladed configuration of the preferred embodiment of ceiling fan 10, each flange 78 must be configured to comprise an arcuate portion of ring 80 subtended by an angle of approximately 72° in order for ring 80 to be substantially unbroken. When so configured, ring 80 and upper lip portion 52 of switch housing 22 cooperate to effectively shield from view proximate ends 64 of blade irons 62 and associated screws 70, thereby creating an aesthetically attractive and unique configuration for ceiling fan 10.

Figure 7:
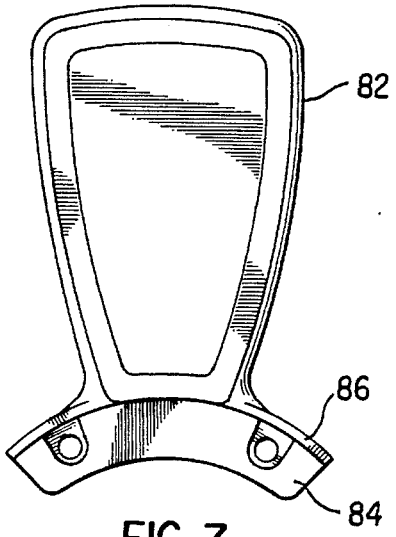
FIG. 7 is a bottom plan view of an alternative embodiment for the blade iron of the present invention.
Figure 8:
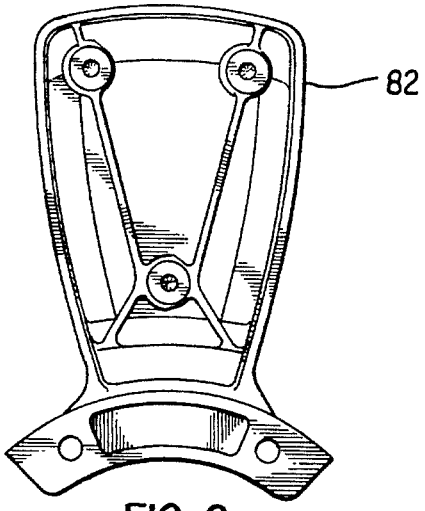
FIG. 8 is a top plan view of the alternative embodiment shown in FIG. 7.

FIGS. 7 and 8 depict blade irons 82, which represent an alternative embodiment for this invention wherein only four blades are employed, rather than five. The proximate ends 84 of blade irons 82 have flanges 86 formed thereon, wherein flanges 86 of the four blade irons 82 collectively form a substantially continuous ring as described above. The only difference between the alternative embodiment blade irons 82 and the preferred embodiment blade irons 62 is the length of flange 86. With blade irons 82, flanges 86 must be configured to comprise an arcuate portion subtended by an angle of 90° , in order for the four blade irons 82 to form a substantially continuous 360° ring around upper lip portion 52 of switch housing 22.

As mentioned above, screws 76 are inserted through blades 20 from the top sides thereof to conventionally engage threaded bosses 74. Since the threaded holes in bosses 74 do not extend through the bottom surface of blade irons 62 (or 82), the view of the blade irons 62 from below is of an essentially smooth surface, undisturbed by any screws or other fastening means. Accordingly, the view of ceiling fan 10 from below is similarly free of any undesirable and unattractive fastening means for securing blades 20 to motor 16.

Figure 3:
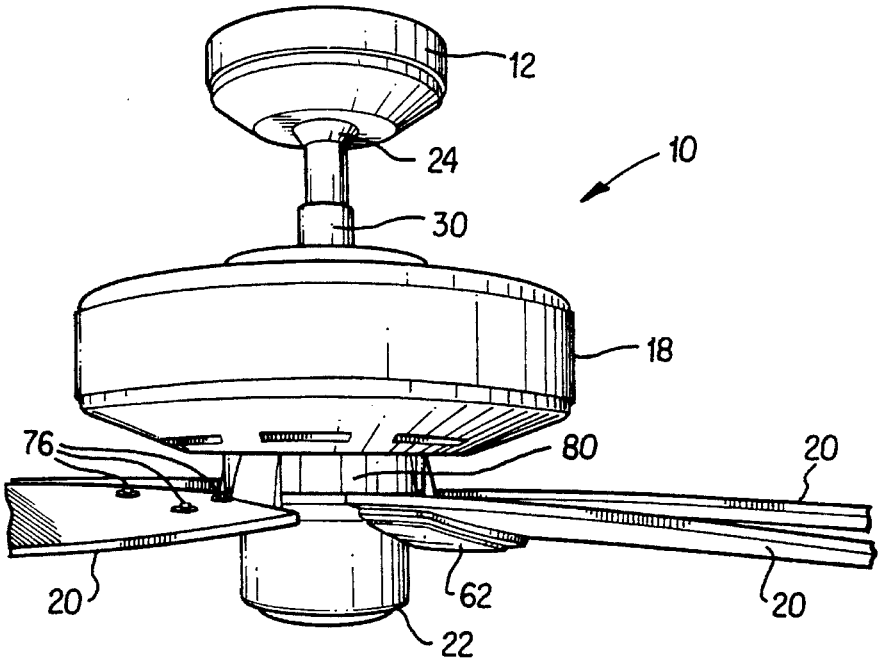
FIG. 3 is a side elevational view of the preferred embodiment of the present invention.
Figure 9:
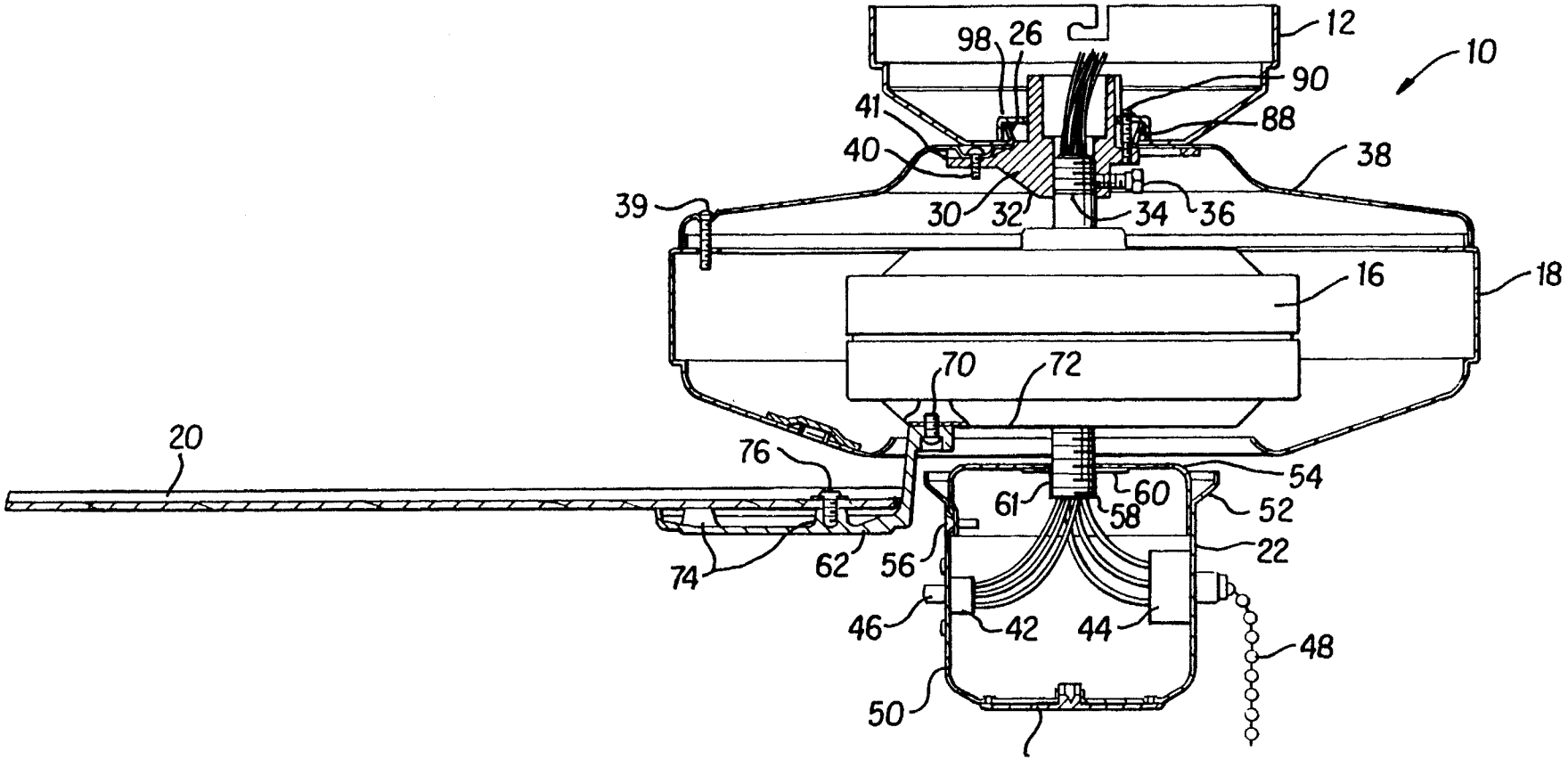
FIG. 9 is a side sectional view similar to FIG. 2, showing the preferred embodiment of the ceiling fan mounted close to the ceiling.
Figure 10:
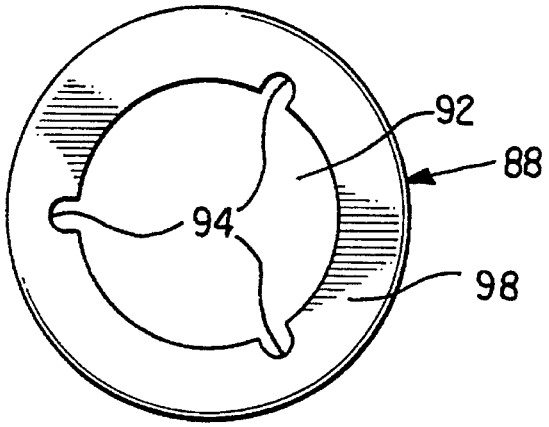
FIG. 10 is a top plan view of the mounting ring employed to mount the ceiling fan close to the ceiling as shown in FIG. 9.
Figure 11:
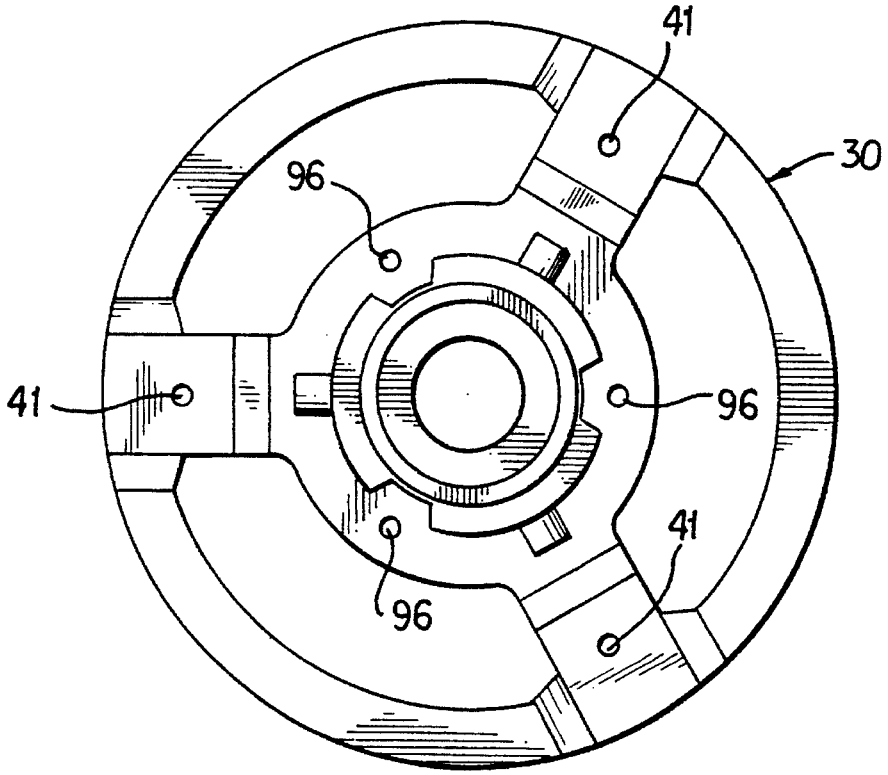
FIG. 11 is a top plan view of the adapter employed to secure the fan motor to either the down tube or the mounting ring.

Like many ceiling fans presently available on the market, ceiling fan 10 may be suspended at a distance from a ceiling as shown in FIGS. 2 and 3, are mounted close to the ceiling as shown in FIG. 9. In this configuration, down rod 14, ball member 24, end set screw 28 are omitted, and top portion 38 of motor housing 18 directly to canopy 12 by means of ring 88 and a plurality of screws 90. As illustrated in FIGS. 10 and 11, ring 88 has a generally circular central opening 92 with three indentations 94 formed at equally spaced intervals therein. Indentations 94 operate to receive three screws 90 and engage the head portions thereof, screws 90 being operative to engage threaded holes 96 formed in adaptor 30. Outer annular lip 98 of ring 88 is adapted to completely circumscribe socket 26 so that, upon assembly as shown in FIG. 9, top portion 38 of motor housing 18 is substantially rigidly secured to canopy 12.

Those skilled in the art will readily appreciate the fact that ring 88, working in conjunction with screws 90 and adaptor 30, eliminate the need for any additional mounting holes in canopy 12 as required by most conventional ceiling fans. It will also be readily apparent that the precise configuration of ring 88 and adaptor 30, as well as the number of screws 90, may vary considerably without departing from the scope of the present invention.

From the above detailed description of the preferred and alternative embodiments of the present invention, it will be appreciated that a ceiling fan has been described wherein the switch housing operates to conceal from view the fastening means utilized to secure the blades to the motor, and that the blade irons cooperate with the switch housing to provide a uniquely configured ceiling fan suitable for use in most conventional applications. Although specific embodiments have been so described, it is to be understood that various changes, substitutions, and alterations can be made therein without departing from the spirit and the scope of the invention as defined by the appended claims.

What is claimed is:

1. A ceiling fan comprising:

a motor, comprising a generally stationary member having a top portion and a bottom portion, and a rotor having a bottom portion, said rotor being rotatable about said stationary member upon operation of said motor;

means for suspending said motor from a ceiling, including a canopy removably securable to the ceiling, having a centrally located opening formed therein, the perimeter of said opening defining a socket, an adapter having top and bottom portions, said bottom portion being secured to said top stationary portion of said motor and said top portion being received within said opening in said canopy, a ring member disposed within said canopy, having a central opening for receiving said top portion of said adapter, said ring member being adapted to engage said canopy generally adjacent said socket, and means for fastening said ring member to said adapter, thereby securing said motor to said canopy;

a motor housing enclosing at least a portion of said motor;

switch means for selectively controlling the operation of said motor;

a plurality of blade irons rotatable with said rotor, each having a proximate end removably securable by suitable fastening means to said bottom portion of said rotor and a distal end extending radially outwardly therefrom;

a plurality of blades, equal in number to said blade irons, each having a proximate end secured to said distal end of a corresponding blade iron;

a switch housing for containing said switch means, securable to said bottom portion of said stationary member, said switch housing having a side member, an upper edge in close proximity to said fastening means, and a lower edge spaced vertically apart from said upper edge, wherein said fastening means are disposed radially outwardly from said side member, and said upper edge of said switch housing is flared radially outwardly to substantially conceal said fastening means when the ceiling fan is viewed from below.

2. A ceiling fan as set forth in claim 1, wherein:

said adapter includes an intermediate section having a plurality of threaded holes formed therein;

said ring member includes a plurality of screw engaging surfaces; and said means for fastening said ring member to said adapter comprise a plurality of screws passing through said screw engaging surfaces on said ring member and threadingly engaging said threaded holes in said intermediate section of said adapter.

3. A ceiling fan having a hanging assembly adapted for mounting close to a ceiling, said assembly comprising:

a motor, having an upper stationary member;

a canopy removably securable to the ceiling, having a centrally located opening formed therein, said canopy also having inner and outer surfaces;

an adapter having top and bottom portions, said bottom portion being secured to said upper stationary member of said motor and said top portion being received within said opening in said canopy;

a ring member disposed within said canopy, having a central opening for receiving said top portion of said adapter, said ring member being adapted to engage a portion of said inner surface of said canopy adjacent said opening in said canopy; and means for fastening said ring member to said adapter, thereby securing said motor to said canopy.

4. A ceiling fan having a hanging assembly as set forth in claim 3, wherein:

said adapter includes an intermediate section having a plurality of threaded holes formed therein;

said ring member includes a plurality of screw engaging surfaces; and said fastening means comprise a plurality of screws passing through said screw engaging surfaces on said ring member and threadingly engaging said threaded holes in said intermediate section of said adapter.

5. A kit for mounting a ceiling fan to a ceiling either with or without a down rod, said ceiling fan having a motor with an upper stationary member and a canopy removably securable to the ceiling with a centrally located opening formed therein, the perimeter of said opening defining a socket adapted to receive a ball member attached to said down rod for use in mounting the ceiling fan at a distance from said ceiling, said kit comprising:

an adapter having top and bottom portions, said bottom portion being secured to said upper stationary member of said motor, said top portion being removably securable to said down rod when said ceiling fan is mounted at a distance from said ceiling;

a ring member, having a central opening suitable for receiving said top portion of said adapter and an outer dimension larger than said opening in said canopy; and means disposable through said central opening in said canopy for removably fastening said ring member to said adapter; whereby said ceiling fan may be mounted close to the ceiling by removing said rod and said ball member, placing said ring member inside said canopy, inserting said top portion of said adapter through said opening in said canopy, and fastening said ring member to said adapter utilizing said fastening means, and said ceiling fan may be mounted at a distance from the ceiling by securing said down rod to said adapter and engaging said ball member within said central opening in said canopy.

6. A kit as set forth in claim 5, wherein:

said ring member includes a plurality of annularly spaced holes formed there through;

said adapter includes a plurality of threaded holes formed therein; and said fastening means comprises a plurality of screws insertable through said holes in said ring member and threadingly engagable with said threaded holes in said adapter.

7. A method of suspending a ceiling fan from a ceiling either with or without a down rod, said ceiling fan having a motor with an upper stationary member and a canopy removably securable to the ceiling with a centrally located opening formed therein, the perimeter of said opening defining a socket adapted to receive a ball member attached to the down rod for use in mounting the ceiling fan at a distance from said ceiling, said method comprising the steps of:

providing an adapter member having top and bottom portions;

securing said bottom portion of said adapter member to said upper stationary member of said motor, said top portion being removably securable to said down rod when said ceiling fan is mounted at a distance from said ceiling;

providing a ring member, having a central opening suitable for receiving said top portion of said adapter and an outer dimension larger than said opening in said canopy; and providing means disposable through said central opening in said canopy for removably fastening said ring member to said adapter; whereby said ceiling fan is securable close to the ceiling without said down rod by removing said rod and said ball member, placing said ring member inside said canopy, inserting said top portion of said adapter through said central opening in said canopy, and fastening said ring member to said adapter, and said ceiling fan is securable at a distance from the ceiling by removing said ring member, securing said down rod to said adapter, and engaging said ball member within said opening in said canopy.

* * * * *